US006786169B2

(12) United States Patent
Godbersen

(10) Patent No.: US 6,786,169 B2
(45) Date of Patent: Sep. 7, 2004

(54) LOAD GUIDE SYSTEM FOR PLEASURE CRAFT

(76) Inventor: Byron L. Godbersen, Lake LaJune Estates, Ida Grove, IA (US) 51445

( * ) Notice: Subject to any disclaimer, the term of this patent is extended or adjusted under 35 U.S.C. 154(b) by 0 days.

(21) Appl. No.: 10/290,679

(22) Filed: Nov. 8, 2002

(65) Prior Publication Data

US 2004/0089213 A1 May 13, 2004

(51) Int. Cl.[7] ..... B63B 21/00
(52) U.S. Cl. ..... 114/230.19
(58) Field of Search ..... 114/230.1, 230.15, 114/230.19, 263; 405/218, 219, 220

(56) References Cited

U.S. PATENT DOCUMENTS

| | | | | |
|---|---|---|---|---|
| 3,237,587 A | | 3/1966 | Ross | |
| 3,373,714 A | | 3/1968 | Hart | |
| 3,763,816 A | | 10/1973 | Wilson | |
| 3,783,816 A | * | 1/1974 | de Chassy et al. | 114/230.15 |
| 3,938,462 A | * | 2/1976 | Brandt | 114/230.24 |
| 4,351,259 A | * | 9/1982 | Loire | 114/230.19 |
| 4,391,550 A | | 7/1983 | Rutter | |
| 5,174,234 A | * | 12/1992 | Ryan | 114/230.1 |
| 5,441,007 A | | 8/1995 | Hunt | |
| 6,119,616 A | | 9/2000 | Hannasch | |

* cited by examiner

*Primary Examiner*—Andrew Wright
(74) *Attorney, Agent, or Firm*—Sturm & Fix LLP

(57) ABSTRACT

A load guide system for guiding a craft into a apparatus such as a boat trailer, boat hoist or the like for egress from traveling on the water, the apparatus including a pair of stationary members of a framework spaced from each other and forming thereby an opening through which the craft is driven, the load guide system include a unit pivotally mounted on each stationary member, each unit including an upright pole engageable by the craft as it moves into the opening, and a spring biased pulley and cable assembly interconnected among the spaced members and the framework for biasing the poles toward each other, the normal condition of the poles forming an opening less than the framework opening, whereby upon one pole being engaged by the bow of the craft, should the craft not being centered upon entering the opening, the unit of that pole will act in response to operation of the pulley and cable assembly to force the bow toward the opposite pole, with the unit of the opposite pole reacting similarly, the sequential actions and reactions of the poles due to extension and contraction of the spring continuing until the craft becomes centered within the apparatus and the craft continues to float into the apparatus.

7 Claims, 7 Drawing Sheets

LOAD GUIDE SYSTEM FOR PLEASURE CRAFT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates generally to an improved system for guiding a pleasure craft as it enters the rear end of the framework of a boat trailer or a boat slip or hoist for egress from traveling over the water. More particularly, the present invention is directed to a pair of laterally spaced, pole units pivotally mounted on the framework and disposed at the rear entrance of a receiving structure, such as a boat trailer, slip or hoist, with a spring biased cable and pulley unit also mounted on the framework and operable in connection with the pole units to continually bias each pole unit toward the other upon engagement of the craft with either pole unit, whereby counteracting forces are sequentially applied to the craft to force it to the longitudinal center of the trailer, slip or hoist framework as the craft continues to move therein.

BACKGROUND ART

Description of the Background

Although boat hoists, lifts, docks and other forms of boat slip structures, including pleasure boat trailers, have improved over the years, as the docking of particularly a pleasure craft still depends upon the skill of the individual(s) manning the craft, and as the size or speed of a craft increases, the inertia and the potential for damage or even injury increases.

Damage can occur to either or both the craft or the receiving structure at impact, and it is applicant's experience that no matter the caution to particularly children in a pleasure craft upon docking, the use of hands and legs to aid in docking is still prevalent, thus increasing the chance of permanent injury.

Various methods have been used in the past to either enhance the safety of a boat hoist, or dock, such as various forms of padding, fenders and the like. Often, old tires and other forms of rubber were used. Various types of stationary and roller-type keel guides on hoists and trailers have been tried. Automatic docking systems involving booms, cables, hooks, V-shaped cushions and like devices attached to the dock have been tried and are illustrative of the prior art. While such devices may be of some aid for their particular purpose, there remains a need for an improved apparatus for docking a pleasure craft in a centered manner within its respective receiving structure such that damage or injury of any kind is minimized, and such that assistance of another individual either on or off the craft is rendered unnecessary.

BRIEF SUMMARY OF THE INVENTION

The present invention is directed to an improved load guide system for docking a pleasure boat or the like by a spring biased boat centering system which is engaged by the boat as it moves into the framework of a receiving structure, whereby the centering system sequentially moves the boat bow and then the craft proper from side to side within the opening of the structure, assuming the craft upon entering is off center, such that the craft becomes centered within the receiving structure framework as it moves fully into the structure, and with the rear of the craft then held in that position by the spring biased arrangement.

When the craft approaches the receiving structure framework from the front, the operator attempts to guide the craft centrally into an opening defined by a pair of stationary members spaced laterally from each other, forming thereby the opening. Should the bow of the craft be off center upon entering the opening, the instant load guide apparatus is engaged initially by the bow of the craft and operates to center the boat within the receiving structure as the craft continues to move further into the load guide system.

The load guide system comprises a pair of upright poles spaced laterally and centrally within the receiving structure opening, their spacing being less than the width of the structure opening, with each pole spaced outwardly from the longitudinal axis of the receiving structure framework an equidistant amount compared to the outward spacing of the other pole from the axis.

A bracket unit pivotally mounts each pole adjacent a respective end of each stationary member, whereby each pole has at least a portion thereof is swingable in a horizontally disposed arc within the opening. Each bracket unit is held initially in a position where its pole is disposed within the opening, for example, within the left side of the opening, such that should the craft be off center toward the left side of the opening, the left pole will be engaged by the craft. As mentioned hereinbefore, the bracket unit, therefore, on the right side of the hoist opening initially holds its pole within the right side of the opening for the same reason.

To initially hold the left and right poles in the aforementioned positions, a spring biased pulley and cable unit is provided. The unit comprises a pair of cables connected at common ends to one end of an extension spring, the other end of which is connected to the receiving structure framework, and with both cables trained separately through a dual pulley unit also mounted on the framework, and with the other end of one cable connected to one bracket unit for swinging its pole in a horizontal arc due to the condition of the extension spring, and with the other end of the other cable connected to the opposite bracket unit for the same purpose to the opposite bracket unit pole.

In operation, upon one pole being engaged by the craft, that pole will be moved away from the opposite pole with extension of the spring. The action of the spring upon returning to its original condition, however, tends to move that engaged pole, and thus the engaged bow of the craft in the opposite direction and toward the unengaged pole. As that occurs, the craft sequentially engages the other pole, again expanding the spring with the normal reaction of the spring tending to move the other pole against the craft and tending to force the craft back toward the center of the receiving structure opening, thus effecting a wedging action against the craft by the poles due to the action and counteraction of the spring and the cables, to eventually center the craft along the longitudinal axis of the receiving structure.

A primary object of the present invention is to provide an improved pleasure craft load guide docking system and method docking the craft.

Yet another object of the present invention is to provide a load guide system which forms a movable wedge between and behind an opening to a craft receiving structure for automatically centering the craft by an alternating pivoting action of the system within the structure as the boat moves inwardly of the structure.

Still another object of the present invention is to provide a load guide system for use with any type of boat hoist, dock, slip or boat trailer utilizing an opening in the rear defined by a pair of laterally spaced stationary members as part of a receiving structure framework.

Another object of the present invention is to provide an improved load guide system consisting primarily of a pair of laterally spaced, pivotally mounted, upright poles disposed within and centrally-of the receiving structure, each pole adapted to be engaged by the craft, either in unison or sequentially, and a spring biasing unit operable to bias the poles toward the longitudinal center of the structure into which the craft is moving.

An additional advantage of the present invention is the provision for accommodating various sized pleasure craft.

Still another object is to provide a load guide system that allows an individual to easily dock his/her pleasure craft during windy and rough sea conditions.

Other objects, advantages, and novel features of the present invention will become apparent from the following detailed description of the invention when considered in conjunction with the accompanying drawings.

DETAILED DESCRIPTION OF THE INVENTION

Figure 1:
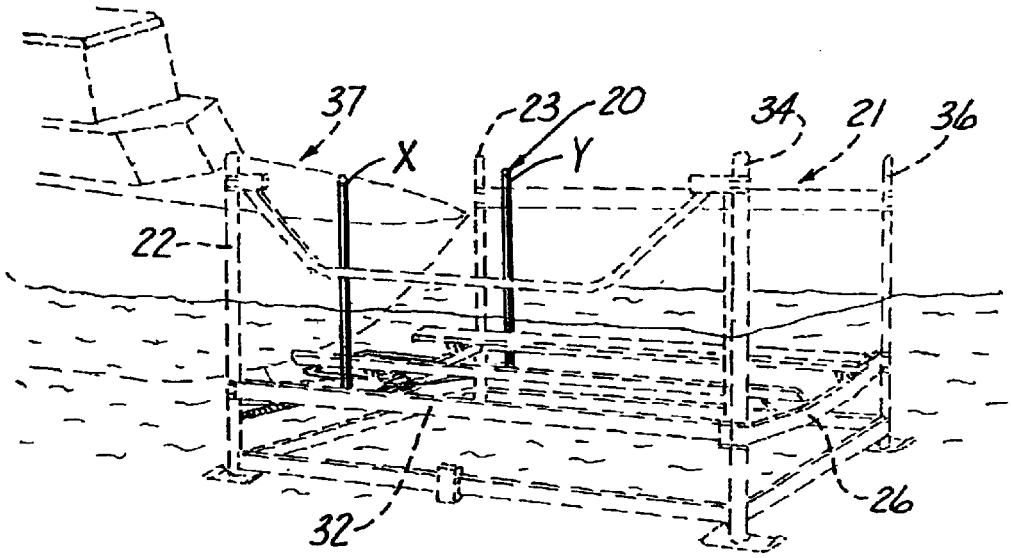
FIG. 1 is a perspective view of the present invention in full lines mounted at the rear end of a receiving structure such as a contemporary boat hoist as shown in dashed lines.
Figures 5, 6:
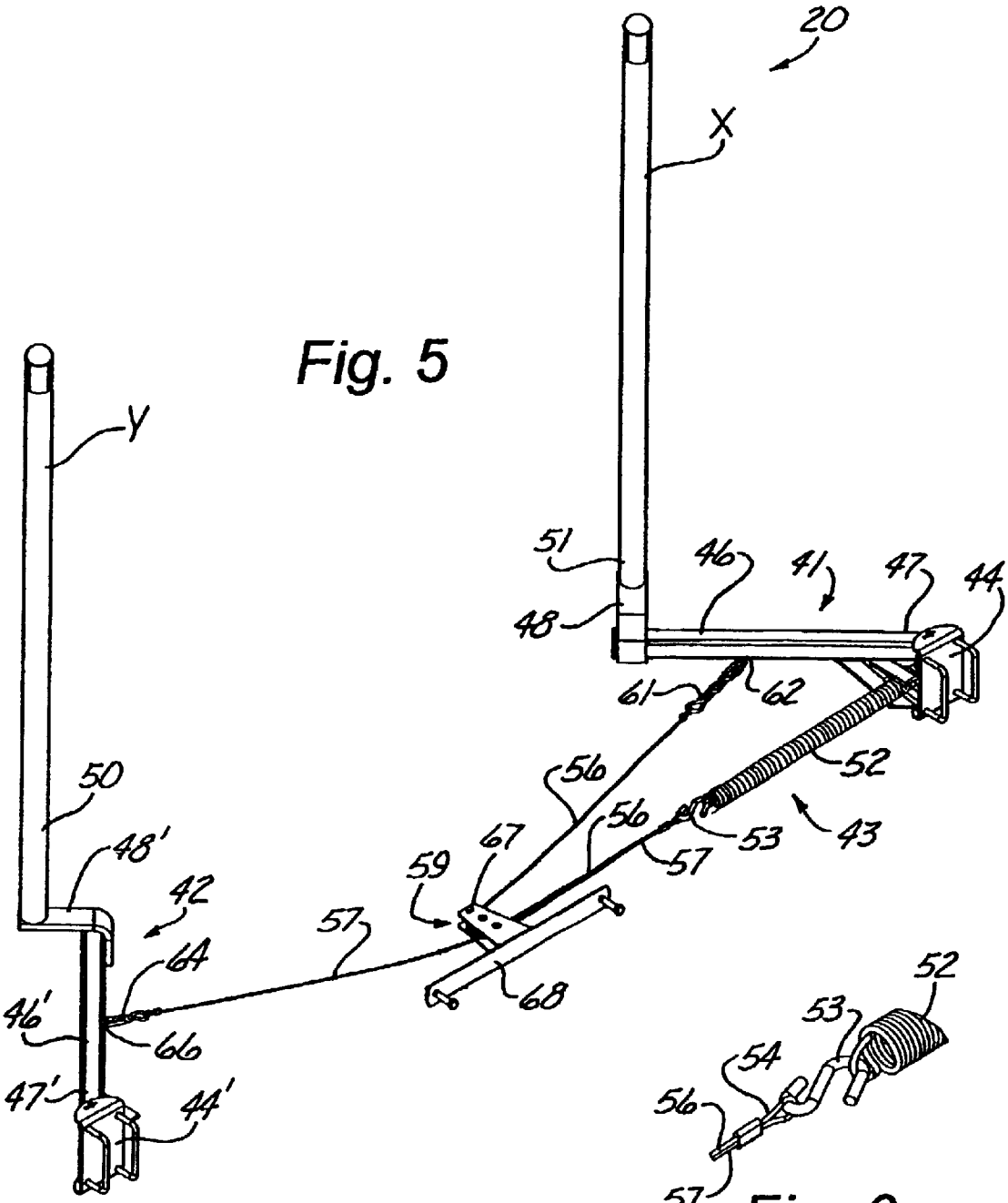
FIG. 5 is a perspective view of the invention as taken from the outside of the boat hoist looking inwardly thereof, and toward the landward front of the hoist, a view opposite that of FIG. 3.
FIG. 6 is an enlarged perspective view of a spring and dual cable end connection.

Referring now to the drawings, wherein similar reference numerals and characters note similar elements throughout the several views, the load guide system of this invention is indicated generally at (20) in FIGS. 1 and 5 and is shown in this particular environment mounted on the framework of a contemporary four post boat hoist shown in dashed lines by the numeral (21) (FIG. 1).

Figure 3:
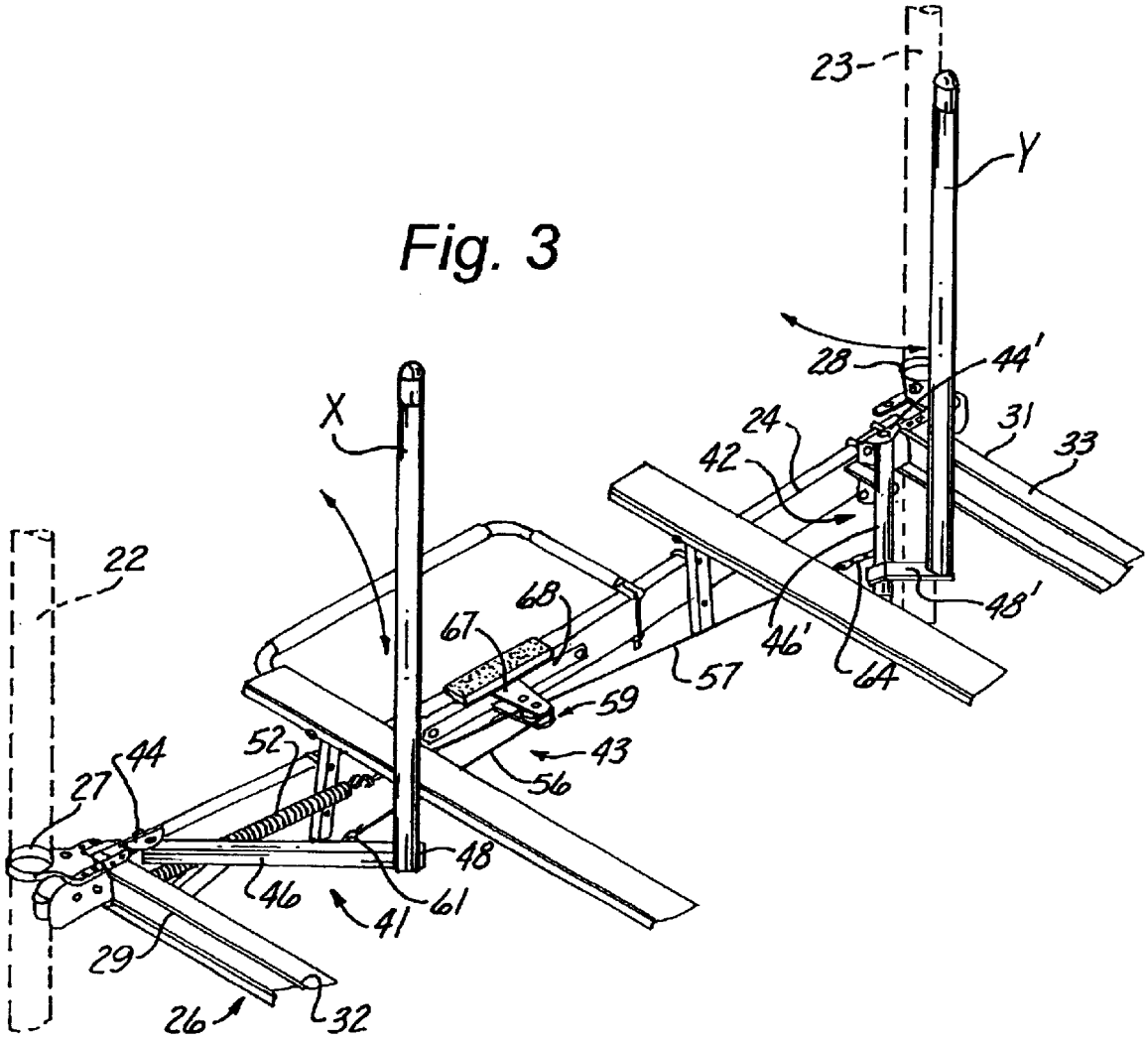
FIG. 3 is an enlarged perspective view of the invention in its normal condition prior to engagement by a craft, posts of the boat hoist shown in dashed lines, the view taken from behind the rear of the hoist looking seaward therefrom.

It is to be noted that the load guide system (20) may be mounted on any receiving structure such as a boat hoist, slip, dock or the like using only a pair of laterally spaced posts, such as (22), (23) (FIG. 3) and between which is, extended a beam such as (24) (FIG. 1).

The instant boat hoist (21), which is not part of this invention, has a framework which includes not only the forward posts (22), (23), but also a rectangular lift platform (26) vertically slidably mounted on the forward posts (22), (23) by slide rings (27), (28) (FIG. 3) at the outer ends (29), (31) of the beam (24), and including further a pair of stationary members (32), (33) at the sides of the platform (26) which extend rearwardly for slidable engagement with rear posts (34), (36) (FIG. 1). The platform (26) is normally disposed sufficiently beneath the water level such that when a craft, indicated at (37) (FIG. 1) in dashed lines, begins to enter the rear entrance of the hoist (21) defined by the front posts (22), (23), the hull of the craft will clear the lift platform (26), whereby upon the craft (37) being completely within the hoist (21) and centered therein, the craft (37) may be lifted out of the water by a raising of the lift platform (26) upon the posts (22), (23), (34), (36), the raising usually by cable means (not shown).

As mentioned hereinbefore, other types of boat lifts, for example, those that use lifting cables alone for raising a lift platform, rather than posts slidably engaged for raising a platform, are envisioned for use in conjunction with the load guide system (20).

Referring particularly to FIG. 5, the load guide system (20) comprises generally a first pole (X), a second pole (Y) disposed laterally of the first pole (X), a first unit (41) pivotally mounting the first pole (X) adjacent the rear end (29) (FIG. 3) of the member (32), a second unit (42) pivotally mounting the second pole (Y) adjacent the rear end (31) (FIG. 3) of the other member (33), and a biasing unit (43) mounted centrally of the beam (24) and interconnected among the first unit (41), the second unit (42) and the receiving structure beam (24). The unit (43) is operable for biasing the first and second poles (X), (Y), toward each other to a normal position best illustrated in FIG. 3 wherein the first and second poles (X), (Y) are equidistantly spaced from and inwardly of the side rails (32), (33), respectively, and are laterally disposed between and slightly behind the posts (22), (23) so as to form a wedge outline with the posts (22), (23) for reasons hereinafter detailed. It will be noted also that each pole (X), (Y) is biased toward the opposite stationary member (32), (33).

As mentioned hereinbefore, the front posts (22), (23) and the beam (24) extended therebetween define an opening into the hoist (21) through and into which the boat (37) enters, such that the poles (X), (Y) are slightly behind the hoist opening.

More particularly, the poles (X), (Y) are identical, may be hollow and flexible, and are of a length such that, regardless of the vertical position of the first and second mounting units (41), (42), the poles (X), (Y) extend sufficiently high to be engageable by the craft (37) upon its entering the hoist (21).

As the first and second pole mounting units (41), (42) are identical, only unit (41) will be described, the other second unit (42) parts indicated by similar reference numerals using a prime symbol. That unit (41) includes: a bracket (44) (FIG. 5) adapted to be connected to either a beam (24) (FIG. 3); or, for example, to an upright member such as a post (22) were the platform (26) not slidably engaged with the posts, or for example to the rear end (31) of an adjacent stationary member (33); an arm (46) pivotally attached at an inner end (47) to the bracket (44) so as to swing through a horizontally disposed arc about the bracket (44), and a flange (48) secured at the outer end of the arm (46) for supporting the first pole (X). Although not shown, the flange (48) preferably has a vertically disposed shaft receivable within the base (51) of the first pole (X) such that the pole (X) may rotate on the flange (47) about a vertical axis upon being engaged by a boat. The arrangement of the base (50) of the pole (Y) with its flange (48') would be similar.

Figure 4:
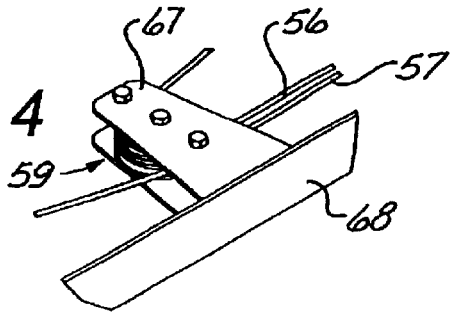
FIG. 4 is an enlarged perspective view of a pulley and cable center bracket.

The biasing unit (43) (FIG. 5) includes a coil-type extension spring (52) connected at one inner end to the receiving structure framework adjacent the first unit bracket (44), connected at the opposite, outer end via an S-hook (53) (FIG. 6) to the joined common ends (54) of a pair of cables (56), (57), one cable (56) of which is trained through a dual pair (59) (FIG. 4) of superimposed pulleys and reversed back via a chain (61) to a connection (62) with the first unit arm (46) intermediate the first unit bracket (44) and flange (48), and the other cable (57) of which is trained through the dual cable pair (59) and extended on via a chain (64) to a connection (66) with: the second unit arm (46') intermediate the second unit bracket (44') and flange (48'). The cables (56), (57) have substantially equal lengths.

The biasing unit pulley pair (59) is mounted for rotation about a vertical axis. On a bracket (67) (FIG. 4) secured by a plate (68) (FIG. 3) centrally of the beam (24) and the receiving structure framework, and the distances from the pulley pair (59) centers of rotation to the respective arm connections (62), (66) are substantially equal.

Figure 7:
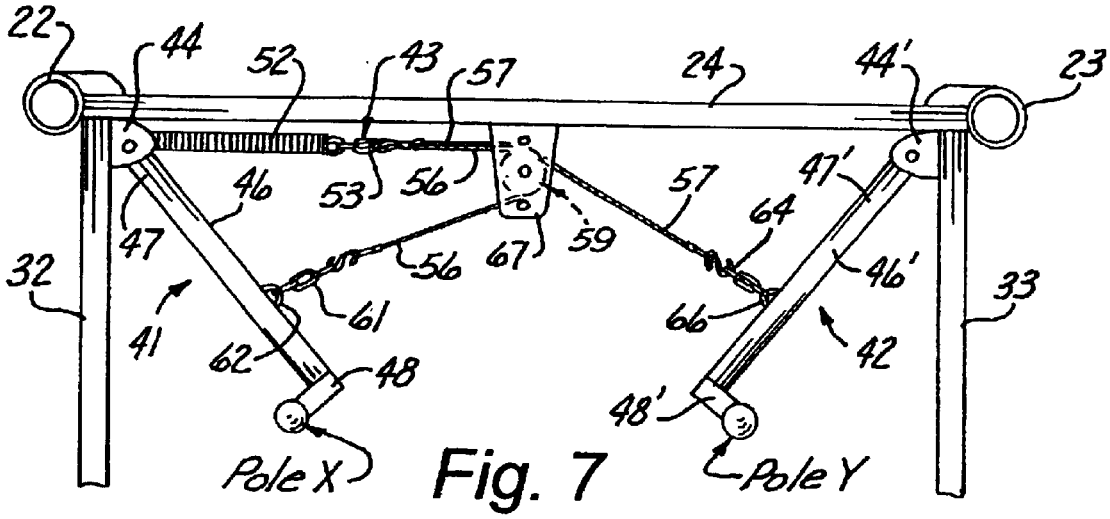
FIG. 7 is a reduced plan view of the structure of FIG. 3, showing the normal position of the load guide system upright poles X and Y prior to engagement by a craft (not shown) entering the boat hoist, comparable to the illustration on the far left side of the FIG. 2 illustration.

Referring to FIG. 7, it will be noted that the positions of the first unit arm (46) and pole (X), and the second unit arm (46') and pole (Y) relative to the beam (24) and to their respective side members (32), (33) are substantially identical, in the normal condition of the load guide system (20). Each arm (46), (46') is spaced arcuately an equal distance inwardly of their respective side members (32), (33). It will be noted further that the poles (X) and (Y) are spaced an equal distance outwardly and away from an imaginary longitudinal centerline or axis of the boat hoist (21); with the poles (X) and (Y) located, in plan, on a transverse line parallel to the beam (24) and parallel to an imaginary line extending across the receiving structure opening between the front posts (22), (23).

Figure 8:
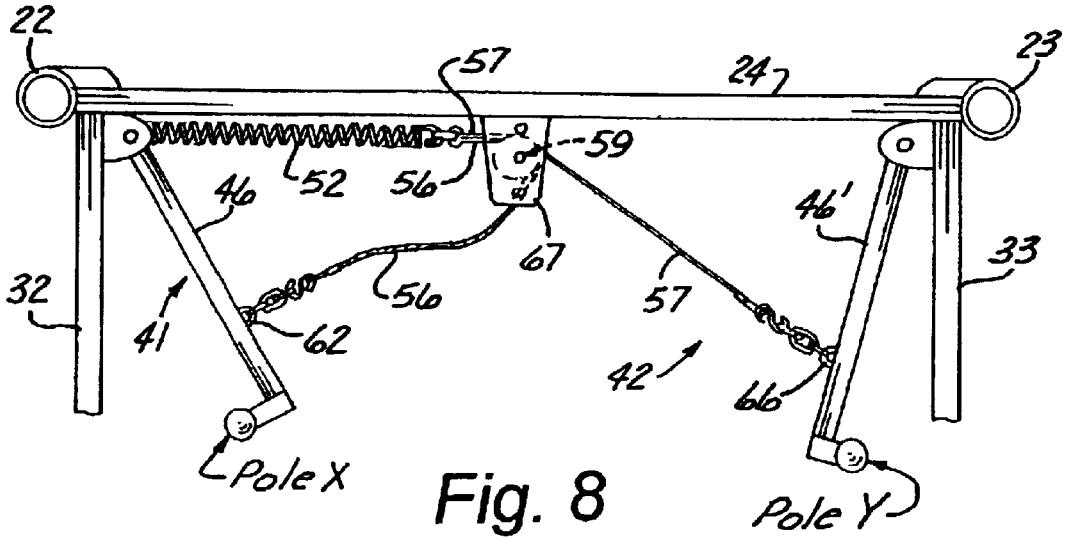
FIG. 8 is a view similar to FIG. 7, and showing the relative moved positions of poles X and Y after pole Y has been engaged by the craft (not shown) entering the boat hoist.
Figure 9:
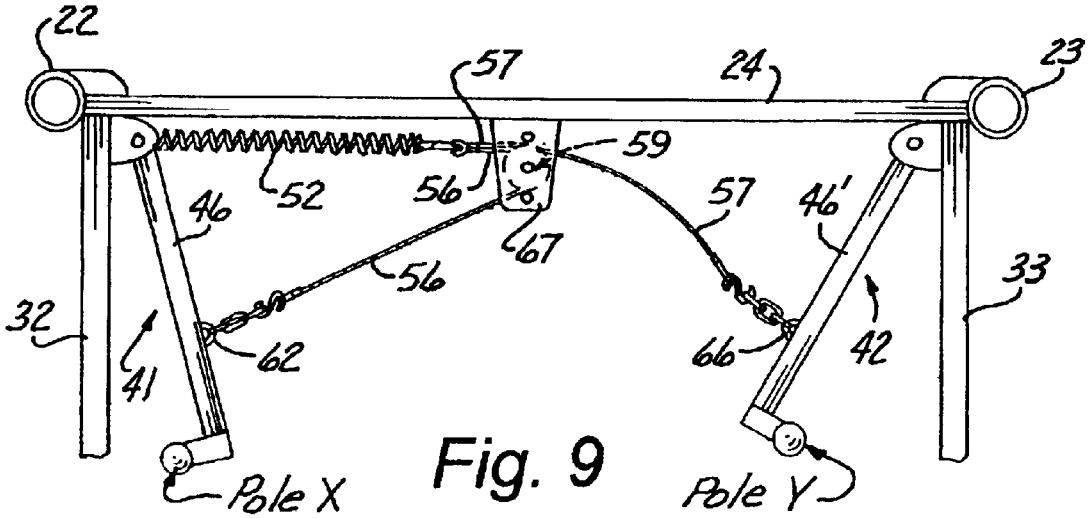
FIG. 9 is a view similar to FIG. 8, and showing the relative moved positions of poles X and Y after pole X has been sequentially engaged by the craft (not shown) subsequent to engagement of the craft with pole Y in FIG. 8.
Figure 10:
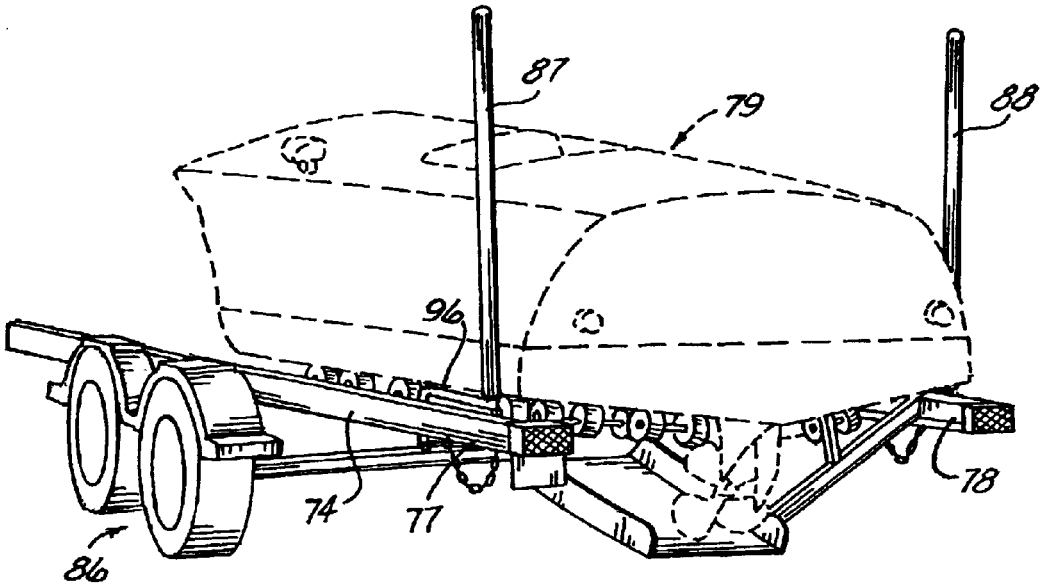
FIG. 10 is a perspective view of a second embodiment of the load guide system as applied to the rear end of a contemporary boat trailer, the rear end of a pleasure craft being shown in dash lines as mounted on the trailer.
Figure 11:
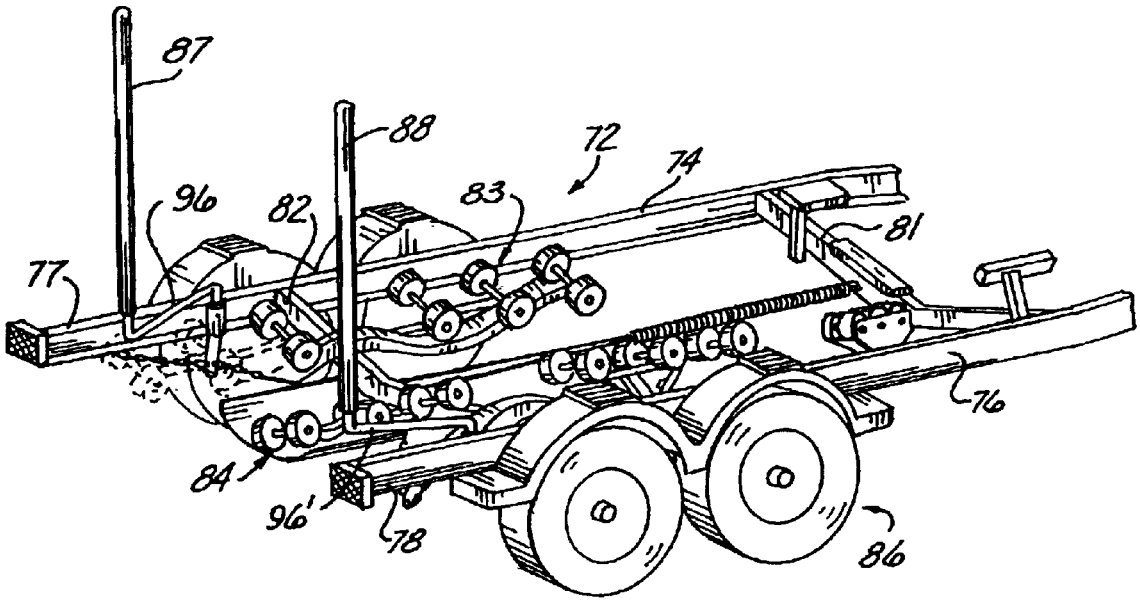
FIG. 11 is a perspective view of the load guide system as mounted on the rear end of a contemporary trailer taken from a different angle as FIG. 11.

In operation of the load guide system (20), FIGS. 2 and 7–9 should be primarily referred to. As the craft (37) (FIG. 2) approaches the hoist, it will be seen that in the present case, the craft (37) is off center and strikes the left pole (Y) (FIG. 2) as the craft (37) moves through the hoist opening between the posts (23), (24). This engagement by the craft (37) of pole (Y) results in the pole (Y) and its mounting unit arm (46) (FIG. 8) being moved arcuately in a rearward and sideward direction away from pole (X) and member (32). As the cable (57) for pole (Y) must necessarily move a like degree as the pole (Y), the additional length is provided by the spring (52) being expanded such that the cable (57) may move about the pulley (59). This action results in the cable (56) also being lengthened, in effect, such that the tension initially of the cable (56) on the pole (X) unit (42) is decreased, thus FIG. 8 shows slack in cable (56).

Figure 2:
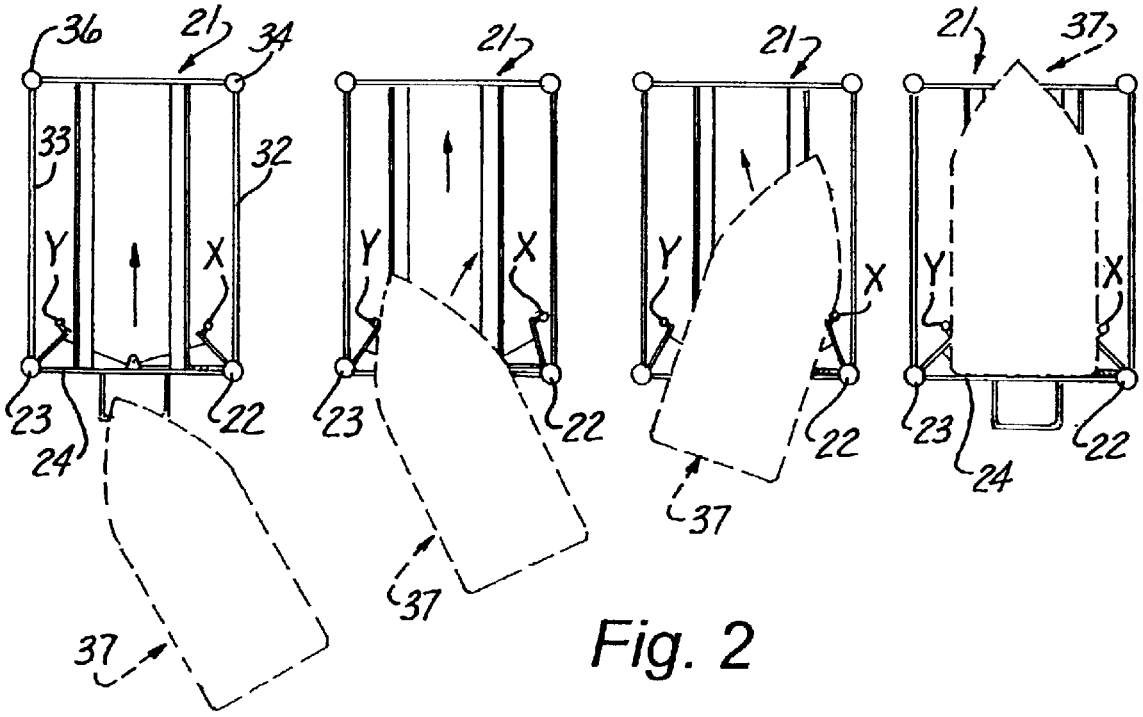
FIG. 2 is a series of reduced plan views of the invention in combination with the boat hoist, and, as viewed from left to right, showing the changed position of certain parts of the invention as it performs its wedging action to center a pleasure craft as the craft enters the boat hoist.

The reaction, however, of the expanded spring (52) is to contract, and as this occurs, the cable (57) retracts toward its original position (FIG. 7) and in so doing pole (Y) moves the bow of the craft (37) in the opposite direction and toward pole (X) (FIG. 2, third panel from the left). Upon the craft (37) engaging the pole (X), the same action and reaction as to pole (Y) occurs, the pole (X) and its cable (56) being arcuately moved away from pole (Y) and toward the side member (32) of the platform (26), thus slackening the cable (57) (FIG. 9), but with the reaction of the spring (52) moving the craft (37) back in the opposite direction toward the center of the hoist (21) due to biased movement of the pole (X).

It is thus seen that a sequential engagement of the craft (37) by one pole (X) or (Y), and then the other, depending upon which pole is first engaged, occurs, with the units (41) and (42) acting and reacting due to the spring (52) and cables (56), (57) biasing action to eventually center the craft (37) within the hoist (21); the units (41) and (42) themselves in the centered condition (FIG. 2, fourth panel from the left), the spring (52) under an increased expanded condition due to the width of the craft (37). As the spring extension may be readily overcome by movement of the craft, and with but slight friction between the boat and the poles (X) and (Y), a backing of the craft (37) out of the hoist (21) is not impeded by the load guide system (20).

Referring now particularly to FIGS. 10–13, a second embodiment of the load guide system (70) as mounted on the framework (71) of a conventional boat trailer (72) (FIG. 12) only the rear (73) (FIG. 11) of which is illustrated, it being understood that the front (not shown) of the trailer (72) is conventional. Other than serving as the vehicle to which the instant load guide system (70) is mounted, the trailer framework (71) is not part of the instant invention, as is the same case with the framework of the aforementioned boat hoist (21).

That noted, the framework (71) includes at least a pair of spaced, side frame members (74), (76) each with a rear end (77), (78), respectively. The side frame members (74), (76) extend forwardly in a converging manner (not shown) to form a tongue structure (not shown) for mounting a winch assembly (not shown) for pulling the craft (79) onto the trailer, and for releasing the craft to removal off the trailer (72). A pair of longitudinally spaced cross members (81), (82) (FIG.12) extended between the side members (74), (76) may be provided for supporting gangs of roller units (83), (84) (FIG. 11). out which the craft is rollably mounted and one of the cross members may serve as the axle support for a wheel assembly (86), shown in this instance as a dual wheel assembly. In use of the load guide system (70), it will be understood that the trailer (72) is conventionally backed into the water on a ramp or the like and retained in a stationary condition sufficient that the craft (79), normally under power, is driven forwardly onto the rear end (73) of the trailer (72) and over the roller gangs (83), (84) and toward the winch assembly (not shown). For safe transportation, it is imperative that the craft (79) be driven and loaded onto the trailer (72) such that the longitudinal centerlines of both craft (79) and trailer (72) are aligned.

Generally, the load guide system (70) comprises a first pole (87) and a second pole (88), the poles (87), (88) disposed laterally of each other, each pole (87), (88) disposed in an upright position and each of a length so as to be engageable by the craft (79) (FIG. 10) being docked or guided into the rear (73) of the trailer (72).

The system (70) includes further a first bracket unit (89) for pivotally mounting the first pole (87) onto one (74) of the now stationary, side frame members and operable to move the pole (87) horizontally in an arc toward and away from the frame members (74), (76), and a second bracket unit (91) pivotally mounting the second pole (88) onto the other now stationary side frame member (76) and operable to move the second pole (88) such that the pole (88) moves horizontally in an arc toward and away from both side frame members (74), (76).

Still further, the load guide system (70) includes a biasing unit (92) (FIG. 12) interconnected among the first bracket unit (89), second bracket unit (91), and the trailer framework (71) for biasing the first pole (87) and the second pole (88) into positions whereby they are laterally disposed within the opening formed between the side frame members' rear ends (77), (78) (FIG. 12) so as to narrow the opening sufficient for either pole (87), (88) to be engaged by the craft (79) upon the craft (79) entering the opening.

As the bracket units (89). (91) are identical, only one (89) will be described, with like elements of the second unit (91) identified by the prime symbol.

More particularly, the first bracket unit (89) (FIGS. 12 and 13) includes a sleeve (93) secured to a side frame member (74) adjacent the rear end (77) and mounted to receive an upright portion (94) of an elongated flange (96) in a vertical manner, the flange (96) extended outwardly from the sleeve (93) to receive at its outer end (97) the lower end (98) of the first pole (87). The lower end (98) may be hollow, or all of the pole (87) hollow, (and pole 88) so as to be rotatable upon an upstanding journal portion (99) of the flange outer end (97). Secured to the lower exposed end (101) of the portion (94) is an arm (102). The arm (102) extends substantially horizontally outwardly from the inner end pivotal engagement with the side frame member (74) part of the trailer framework (71) toward the opposite frame member (76) for reasons described hereinafter.

The biasing unit (92) includes a coil-type extension spring (103) connected at one end (104) to one of the cross members (81) of the trailer framework (71), and connected at an opposite end (106) to joined, common ends (107) of a pair of cables (108), (109), one cable (108) of which is trained through a dual pair (111) (FIG. 13) of pulleys and extended to connection with a chain section (112) to the outer end (113) of the first unit arm (102). The other cable (109) is also trained through the pulley pair (111) and extended to a connection with another chain section (114) to the outer end (113') of the second unit arm (102'). The cables (108), (109) have substantially equal lengths.

Figure 12:
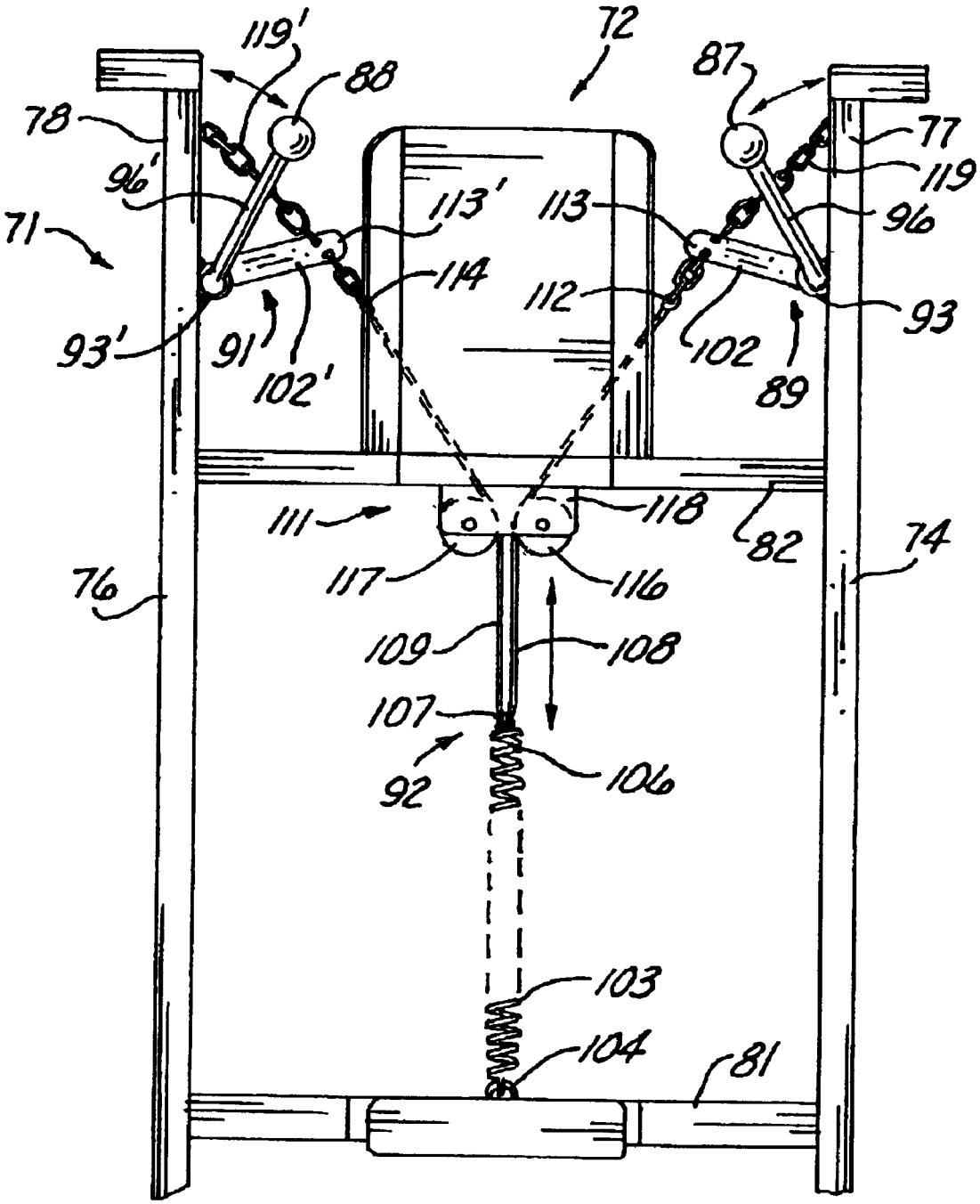
FIG. 12 is a plan view of the load guide system of FIGS. 10 and 11, with the wheel units and the roller gang units removed.

The biasing unit pulley pair (111) comprise a pair of pulleys (116), (117) (FIG. 13) each mounted side-by-side for rotation about a vertical axis on a bracket (118) secured to the cross member (82) (FIG. 12). It will be noted that the distances from the centers of location of the pulleys (116), (117) to the spring end (106) are substantially equal, as are the distances to the outer arm ends (113) and (113').

Referring to FIG. 12, it will be noted that the positions of the first bracket unit (89) and pole (87) and the second bracket unit (91) and pole (88) relative to the respective side frame members (74), (76) are substantially identical in the normal condition of the load guide system (70) with its spring (103) in its normal contracted condition. Each arm (102), (102') is spaced arcuately an equal distance inwardly of their respective side frame members (74), (76). It will be noted further that the poles (87), (88) are spaced an equal distance outwardly and away from an imaginary longitudinal centerline or axis of the trailer (72); with the poles (87). (88) located, in plan, on a transverse line parallel to an imaginary line extending across the trailer rear end (73) between the side frame members' rear ends (77), (78).

The operation of the load guide system (70) is substantially the same as that of the first embodiment system (20) of FIGS. 1–9. Should the approaching craft (79) engage one pole first, pole (87) for example, the pole (87) will be moved arcuately toward the side frame member (74), thus causing an extension of the spring (103) via movement of the arm (102) pulling on of the cable (108). The spring (103) will then tend to contract, thus pulling back on the cable (108) and arm (102) to move the pole (87) against the craft (79) this moving the craft (79) over against the other pole (89). The same action of the first bracket unit (89) now occurs with respect to the second bracket unit (91), its arm (102') and cable (109), whereby the craft (79) is subsequently moved back toward the opposite pole (87). Thus, a wedging action of sequential decreasing movement of poles (87), (88) away, then toward each other occurs, effecting a centering movement of the craft (79) until the craft (79) is held between the poles (87), (88) with its longitudinal axis aligned with the longitudinal axis of the craft (71).

Figure 13:
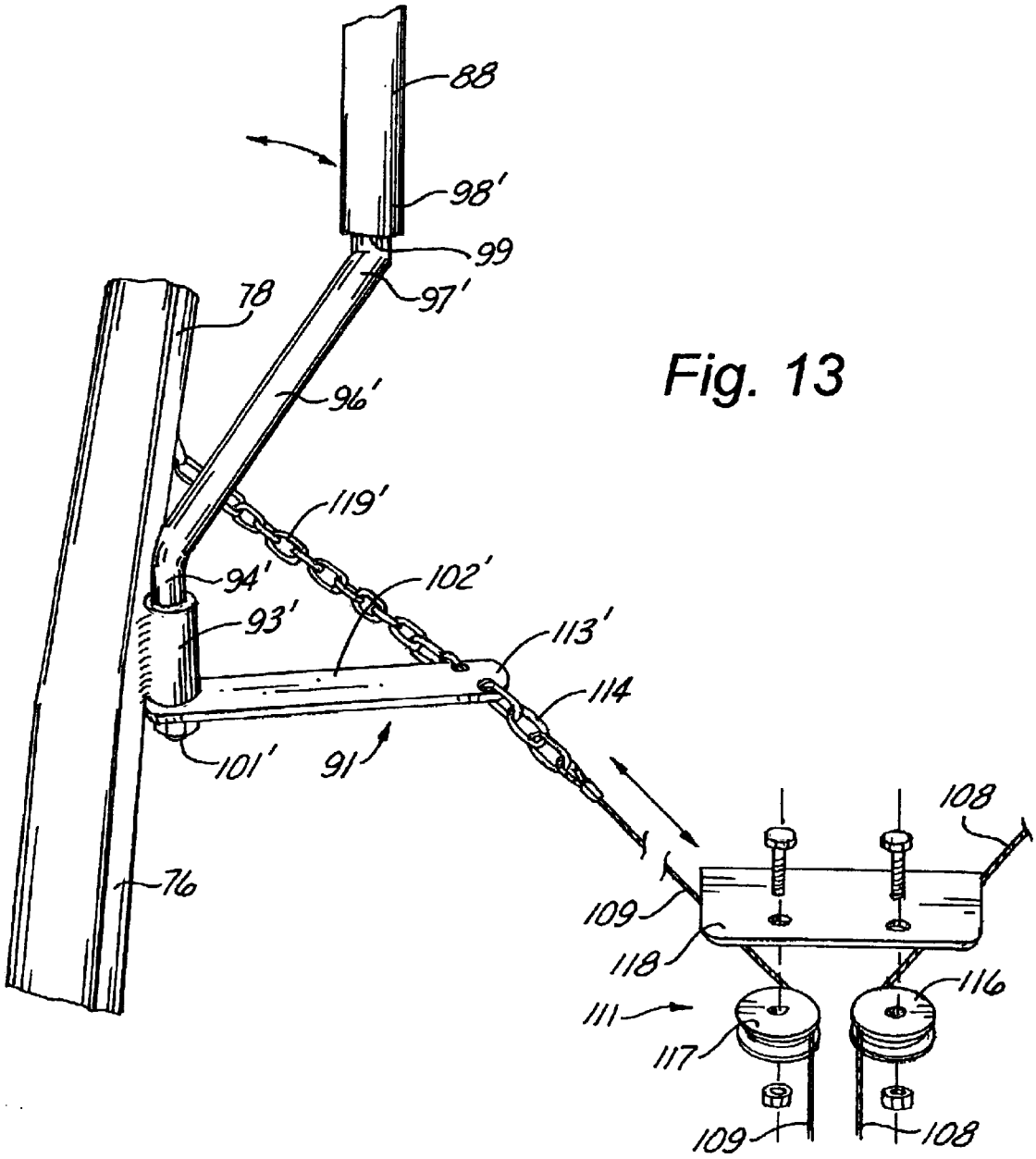
FIG. 13 is an enlarged, exploded view of the biasing unit of the system.

For purposes of safety in operation of the load guide system (70), each bracket unit (89), (91) is provided with a chain (119), (119'), each chain respectively connecting the outer ends (113), (113') of the unit arms (102), (102') with an adjacent side frame member (74), (76) as best illustrated in FIGS. 12 and 13. Thus, as in the normal operation of the system (70), wherein the poles (87), (88) are operable upon initial engagement by the craft (79) to move clockwise and counterclockwise respectively, they are prevented from moving initially in opposite directions, and are at all times prevented from moving further away from their respective side frame members (74), (76) than the positions best illustrated in FIG. 12.

With respect to the above description, it is to be realized that the optimum dimensional relationships for the parts of the invention to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

I claim:

1. In a load guide system for guiding a pleasure craft into a framework, the framework including a pair of spaced, normally stationary members forming an opening through which the craft is driven, the load guide system comprising:

a first pole and a second pole, said poles disposed laterally of each other, each pole disposed in an upright position, said poles each of a length to be engageable by the craft being docked;

first means pivotally mounting said first pole to one of the stationary members, and operable to move said first pole horizontally in an arc toward and away from the stationary members;

second means pivotally mounting said second pole to the other of the stationary members, and operable to move said second pole horizontally in an arc toward and away from the stationary members; and biasing means interconnected among said first means, said second means and the framework for biasing said first pole and said second pole toward each other, whereby said first pole and said second pole are laterally disposed within the opening so as to narrow the opening sufficient for either pole to be engaged by the craft upon the craft entering the opening, said biasing means operable further whereby upon the craft engaging only said first pole, said first pole forces the craft toward said second pole, and upon engagement of the second pole by the craft, said second pole reacts to force the craft back toward said first pole, said biasing of said biasing means upon said poles repeated until the craft is centered within the slip.

2. The load guide system of claim 1, and further wherein said first means includes a first arm having a first arm end and a second arm end, the first arm end pivotally mounted to the framework, said second arm end extended toward one stationary member, and wherein said second means includes a second arm having a first arm end and a second arm end, the first arm end of the second arm being pivotally mounted to the framework, said second arm end of the second arm extended toward the other stationary member.

3. The load guide system of claim 2 and further wherein said biasing means includes a spring having opposed ends, and connected at one spring end to the framework and connected at the other end to common ends of a pair of cables, a dual pulley unit mounted on the framework, a first cable of said pair of cables trained through the dual pulley unit and with the opposite end of said first cable connected to said first arm adjacent said second arm end of the first arm, a second cable of said pair of cables trained through the dual pulley unit and with the opposite end of said second cable connected to said second arm adjacent said second arm end of the second arm.

4. The load guide system of claim 3, and further wherein said biasing means spring is operable to expand upon engagement of one of the first or second pole by the craft, and is operable to contract in reaction to said expansion to force said first one of the first or second poles against the craft to move the craft toward the other one of the first or second of said poles, said spring being operable further to expand and contract again upon engagement of the craft by said other one of the first or second pole, whereby to force said other one of the first or second pole and the craft toward said one of the first or second pole, said expansion and contraction of said spring continuing to center the craft by engagement of the craft with the respective poles.

5. In a load guide system for guiding a pleasure craft into a framework, the framework including a pair of spaced, stationary members forming an opening through which the craft is driven, said opening having one side thereof and another side thereof. The load guide system comprising:

first means pivotally engaged to one of the stationary members at a place of pivotal engagement and movable toward and away from the other of the stationary members;

second means pivotally engaged to the other of the stationary members at a place of pivotal engagement, and movable toward and away from the one of the stationary members;

said first means including an element engageable by the craft as the craft enters the opening adjacent the one side thereof;

said second means including an element engageable by the craft as the craft enters the opening adjacent the another side thereof; and biasing means interconnected among said first means, said second means, and the framework, said biasing means including a spring having opposite ends and connected at one end to the framework and connected at the other end to a pair of cables of substantially equal length and having opposite ends, said spring other end connected to common ends of said cables, one said cables connected at its other end to said first means and said other cable connected at its other end to said second means, movement of said first means element by engagement of the craft effecting an extension of said spring via movement of one said cable, retraction of said spring from said extension effecting movement of the craft by engagement of said first means element toward the another side of the opening, movement of said second means element by engagement of the craft effecting another extension of said spring via movement of said other cable, retraction of said spring from said another extension effecting movement of the craft by engagement of the said second means element toward the one side of the opening.

6. The load guide system of claim 5, and further wherein said biasing means includes a dual pulley unit mounted centrally of the framework between the stationary members, wherein said cables are both trained intermediate their ends through said dual pulley unit.

7. The load guide system of claim 6, and further wherein said first means includes a first arm extended outwardly from said place of pivotal engagement of said first means with said one of the stationary members, and movable within a horizontally disposed arc, the said other end of said one cable connected to said first arm at a point thereon spaced away from said place of pivotal engagement of said first means with said one of the stationary members, and said second means includes a second arm extended outwardly from said place of pivotal engagement of said second means with the other stationary member, and movable in a horizontally disposed arc, the said other end of said other cable connected to said second arm intermediate the length of said second arm at a point thereon spaced away from said pivotal engagement of said second means with the other stationary member, said first and second arms having substantially identical lengths.

* * * * *